US005873563A

United States Patent [19]

Hoving, III

[11] Patent Number: 5,873,563

[45] Date of Patent: Feb. 23, 1999

[54] VALVE LOCK

[76] Inventor: George Hoving, III, 2140 Lincoln Rd., Allegan, Mich. 49010

[21] Appl. No.: 512,881

[22] Filed: Aug. 9, 1995

Related U.S. Application Data

[63] Continuation of Ser. No. 106,067, Aug. 13, 1993, abandoned.

[51] Int. Cl.[6] ..... F01L 3/10

[52] U.S. Cl. ..... 251/337; 123/90.67; 123/188.13

[58] Field of Search ..... 251/337; 123/90.67, 123/188.13

[56] References Cited

U.S. PATENT DOCUMENTS

| | | | |
|---|---|---|---|
| 2,065,794 | 10/1936 | Colwell . | |
| 2,827,031 | 3/1958 | Newton | 123/90.67 |
| 3,041,715 | 4/1962 | Norton . | |
| 3,416,771 | 12/1968 | Updike . | |
| 4,432,311 | 2/1984 | Holtzberg et al. | 123/90.67 |
| 4,829,952 | 5/1989 | Barker . | |

*Primary Examiner*—A. Michael Chambers
*Attorney, Agent, or Firm*—Waters & Morse, PC

[57] ABSTRACT

An improved valve lock comprises a plurality of tapered arcuate sections that fit together to provide a sleeve that fits on the tip of a valve stem, with the inner surfaces of the arcuate sections having raised ridges thereon that mate with corresponding valve lock grooves in a valve stem. The axial position of the ridges in the valve locks of the present invention are modified from the position of the ridges for an original equipment engine by an amount sufficient to compensate for a change in compression strength of a used valve spring or a variation in position of the valve stem due to grinding of the valve seats or valve stems. Desirably, the ridges are positioned thirty thousandths (0.030) of an inch outwardly from the position of the ridged in an original equipment valve lock for an engine where the valves have been ground and new valve springs are used, and the ridge position is adjusted sixty thousandths (0.060) of an inch outwardly from the original equipment position when the valves have been ground and the original springs are reused. The valve locks are color coded to readily identify the appropriate valve locks for each particular application.

11 Claims, 2 Drawing Sheets

VALVE LOCK

CROSS REFERENCE TO RELATED APPLICATION

This is a continuation of applicant's patent application, Ser. No. 08/106,067, filed Aug. 13, 1993 entitled VALVE LOCK.

BACKGROUND OF THE INVENTION

In a typical internal combustion engine, a number of valves are mounted in valve openings in a cylinder head, with the valves being biased to a closed position by means of a compression spring that is retained in place by a spring retainer on the tip or outer end of the valve stem. The spring retainer has a tapered opening and is retained on the valve tip by a device called a keeper or valve lock. A valve lock is a sleeve formed into two sections that has one or more ridges on an internal surface that fit in corresponding grooves in the tip of the valve. A valve lock has a tapered exterior surface that mates with the tapered opening in the spring retainer, such that when the spring retainer is urged outwardly by the spring, the tapered opening in the spring retainer clamps against the valve lock and is retained in place.

The spring characteristics of the valve spring are important to the operation of a valve. When a spring becomes old and weak, it loses compression strength and the characteristics of the valve operation deteriorate.

A similar problem arises when an engine is rebuilt. During the cylinder head rebuilding process, both the valve face and valve seat are resurfaced to insure a good seal. This process is sometimes referred to as a "valve job". The operation is always part of the cylinder head remanufacturing process. Because of the grinding process, the valve "sinks" further into the cylinder head. This means that the valve tip protrudes further on the opposite side of the cylinder head. Because the valve tip protrudes further than originally engineered, the valve spring will not be as compressed. To compensate for this, cylinder head rebuilders shim the underside of the valve spring with a shim shaped like a washer in order to reduce the distance from the head to the tip of the valve stem. This is a standard practice throughout the industry. Generally, rebuilders will use a thirty thousandths (0.030) inch shim when new valve springs are being installed and a sixty thousandths (0.060) inch shim when the old springs are used. Since used springs relax slightly over time, a larger shim is necessary in order to compensate both for the grinding of the valves and the lower compression strength of the used spring. The use of shims is an added component and an added expense in the rebuilding process and introduces some heat dissipation considerations by the introduction of a dissimilar metal between the spring and the cylinder head.

An object of the present invention is to eliminate the use of shims in the valve grinding and engine remanufacturing processes.

SUMMARY OF THE INVENTION

In accordance with the present invention, an improved valve lock comprises a plurality of tapered arcuate sections that fit together to provide a sleeve that fits on the tip of a valve stem, with the inner surfaces of the arcuate sections having raised ridges thereon that mate with corresponding valve lock grooves in a valve stem. The ridges are circumferential around the inner surface of the valve lock and are positioned at a predetermined axial position on the valve lock. The predetermined axial position of the ridges in the valve lock of the present invention is adjusted from the position of the ridges for an original equipment engine by an amount sufficient to compensate for a change in compression strength of a used valve spring or a variation in position of the valve stem due to grinding of the valve seats or valve stems. Desirably, the ridges are positioned thirty thousandths (0.030) of an inch outwardly from the position of the ridges in an original equipment valve lock for an engine where the valves have been ground and new valve springs are used, and the ridge position is adjusted sixty thousandths (0.060) of an inch outwardly from the original equipment position when the valves have been ground and the original springs are reused. The valve locks are color coded to readily identify the appropriate valve locks for each particular application.

These and other features of the present invention will hereinafter appear, and for purposes of illustration but not of limitation, a preferred embodiment of the present invention is described in detail below and shown in the appended drawings.

DETAILED DESCRIPTION OF PREFERRED EMBODIMENT

Figure 1:
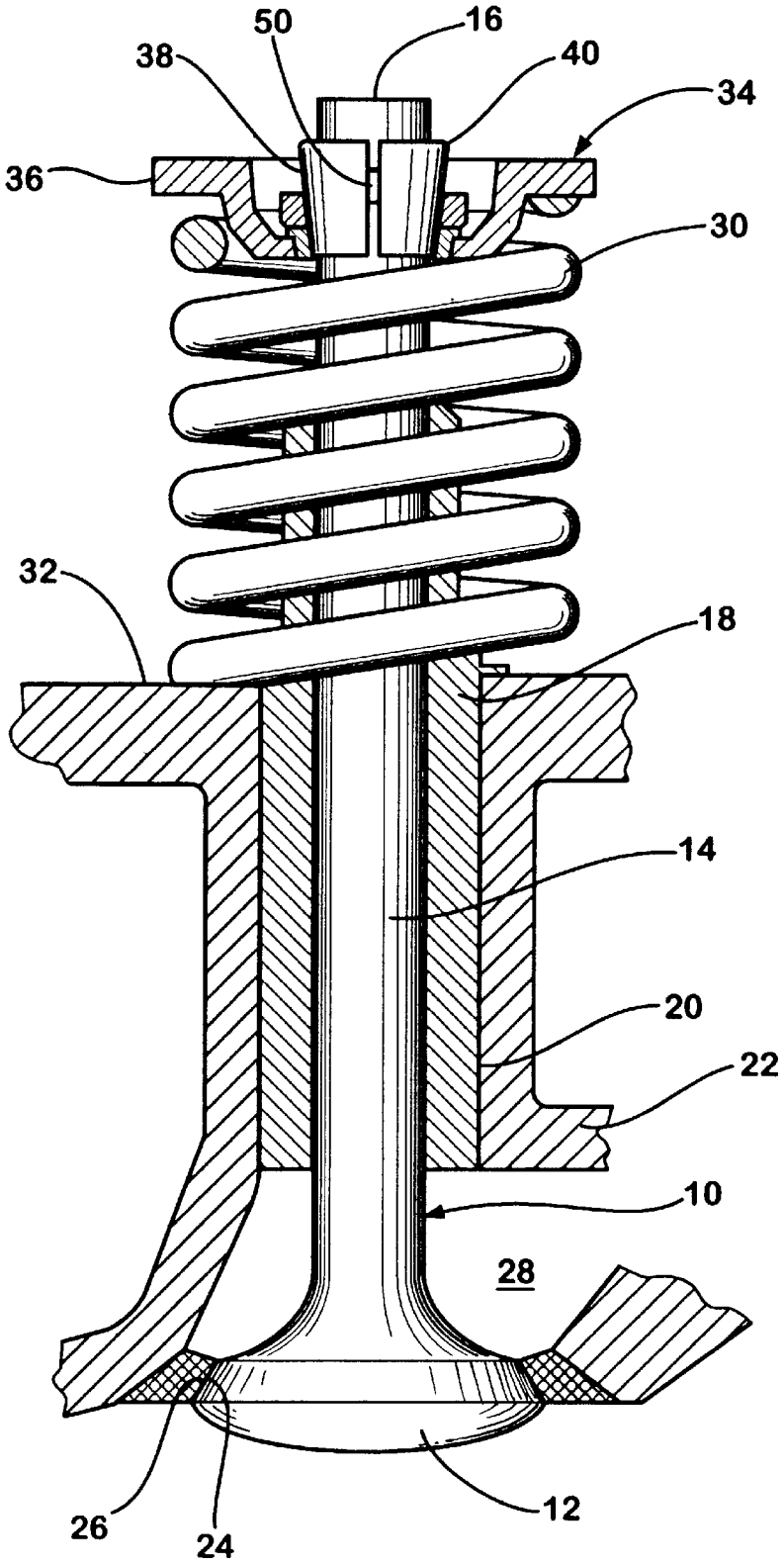
FIG. 1 is a side elevational view shown partly in section, of a valve mounted in an engine and employing the valve lock of the present invention.

Referring to the drawings and more particularly to FIG. 1, a conventional valve 10 having a head 12 and a stem 14 extending to a valve tip 16 is shown mounted in a valve guide 18 in a valve opening 20 in a cylinder head 22. The head of the valve has a beveled face 24 on the rear side thereof, which mates with a bevelled valve seat 26 in the cylinder head. A gas port 28 is positioned behind the valve head for admitting or discharging gas from the combustion chamber of the engine when the valve is open. A valve spring 30 (a compression spring) is positioned adjacent the tip of the valve stem with one end abutting an outer surface 32 of the cylinder head adjacent valve opening 20. A spring retainer 34 is fixed adjacent the tip 16 of the valve stem in order to retain the compression spring on the valve stem in a preloaded, partially compressed condition. The spring retainer 34 comprises a disk shaped radial flange 36 extending outwardly from a center portion that has an upwardly and outwardly tapered opening 38 therein. Opening 38 is larger than the diameter of valve stem 14 so the spring retainer can slide axially on and off the tip of the valve stem.

Spring retainer 34 is mounted on the valve stem by means of a keeper or valve lock 40. Valve lock 40 is comprised of a plurality (preferably two) arcuate sections that fit together to form a sleeve that substantially but not completely encircles the valve stem. Each section has a downwardly and inwardly tapered outer surface 42 that has a minimum diameter that is less than the diameter of opening 38 and a maximum diameter that is greater than the diameter of opening 38. An inner side of each section of the valve lock comprises a cylindrical surface 44 that fits over the valve stem and substantially conforms to the outer diameter of the valve stem. A ridge 46 extends inwardly from the cylindrical wall 44 of the valve stem and forms a circumferential ridge around the valve stem. This ridge fits in a mating groove 50 in the valve stem, such that when the valve lock is engaged in the groove, the valve lock cannot slide axially along the valve stem. The valve lock has a pair of rounded circumferential grooves 52 on each end of the ridge 46. These grooves are for the purpose of stress relief and are conventional in a valve lock.

In the illustrated embodiment, the valve lock and valve stem are shown with a single groove and a single ridge. This is the construction used in about ninety percent of the valves sold in the United States. Other valves and valve locks may use multiple grooves and multiple projections that fit in the grooves.

In operation, a valve is mounted in a cylinder head by inserting the valve upwardly in the direction of FIG. 1 through the valve guide. The compression spring is then placed over the valve stem and compressed, while the spring retainer is placed on the tip of the valve stem. The valve locks are then put in place in the grooves adjacent the valve tip and the spring retainer is released. As the spring retainer slides axially outwardly, the tapered edges of opening 38 engage the tapered side walls of the valve lock and lock the spring retainer on the valve stem by camming the valve lock inwardly into the groove in the valve stem.

Figure 2:
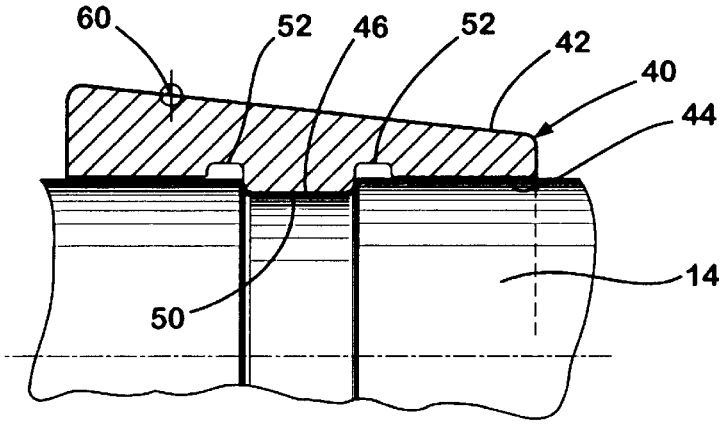
FIG. 2 is an axial sectional view of a valve lock and a portion of a valve stem showing a valve lock having a conventional ridge position for use as original equipment in a new internal combustion engine.

The foregoing is conventional valve construction. In FIG. 2, a typical valve lock is shown with a ridge positioned at a conventional position on the valve lock. The opening in the spring retainer is designed to stop the spring retainer at position 60. This position is accurately determined in order to provide a specifically engineered preload on the compression spring. With a compression spring of specific engineered characteristics, the spring is supposed to have a certain preload that keeps the valve closed tightly against the valve seat until it is opened and then return the valve to its closed position with a specified speed and force. If the spring is too weak, the valve does not snap back into its closed position with adequate speed, and this can cause valve float or other undesirable characteristics when the engine is operating at a higher number of revolutions per minute.

Figure 3:
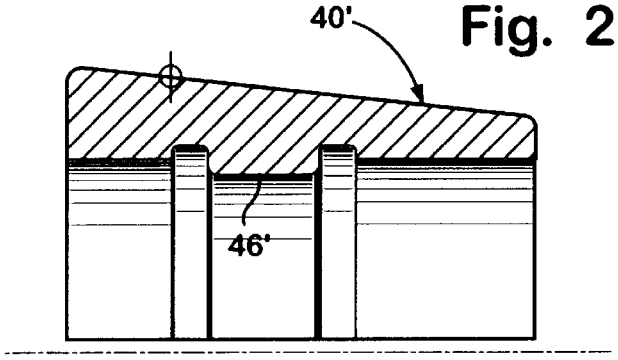
FIG. 3 is a sectional view of a valve lock similar to FIG. 2, showing a valve lock with a modified ridge position for use in an engine wherein the valves have been ground and new valve springs are employed.

When an engine is rebuilt or is given a valve job, valve seat 26 is ground down and the face 24 of the valve head is ground down in order to provide a smooth interface. This causes the valve to extend further outwardly from the opposite side of the cylinder head. This would ordinarily provide less precompression or preload on the valve spring. Rather than using a shim to maintain the original valve spring preload conditions, a modified valve lock 40' is used, as shown in FIG. 3. The ridge 46' in this valve lock is shifted outwardly or to the left (FIG. 3 orientation) by thirty thousandths (0.030) of an inch. In the preferred embodiment, the original ridge 46 is positioned one hundred forty four thousandths (0.144) of an inch from the end, while the ridge in FIG. 3 is positioned one hundred fourteen thousandths (0.114) of an inch from the end. This moves the valve lock thirty thousandths (0.030) inwardly on the valve stem and overcomes the change in position of the valve stem caused by the valve grinding. The thirty thousandths (0.030) ridge is used when a valve job and been done and new valve springs are employed.

Figure 4:
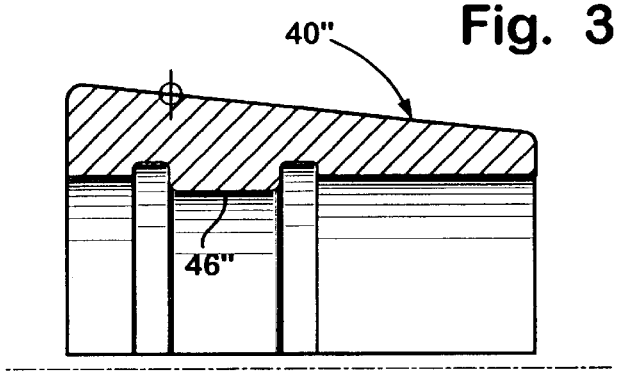
FIG. 4 is a sectional view of a valve lock similar to FIG. 2 showing a valve lock with a modified ridge position for use in connection with an engine wherein the valves have been ground and the used valve spring is not replaced with a new spring.
Figure 5:
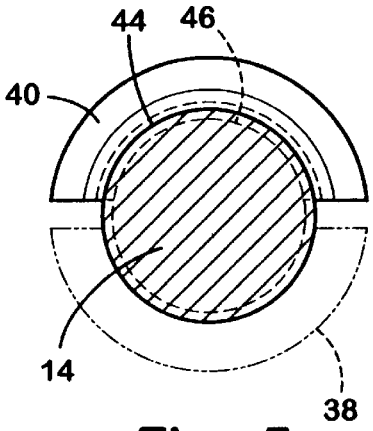
FIG. 5 is an axial end view of a valve tip having a valve lock mounted thereon.

The valve lock 40" of FIG. 4 is substantially the same as the valve lock of the other embodiments, but the ridge 46" is positioned sixty thousandths (0.060) to the left or outwardly from the original equipment position 46 shown in FIG. 2. This position is used for an engine wherein a valve job has been performed but the original equipment springs are reused in the engine. Since the original equipment springs will have lost some of their compressive force through use, the additional thirty thousandths (0.030) is used to achieve the characteristics of the spring as original equipment. Other ridge positions can be used for other position adjustment requirements.

Since engine rebuilders frequently use new valve locks any time they rebuild an engine (and this is a desirable practice in any event), it is simple and less expensive to use the valve locks of the present invention instead of having to incur the expense of using valve shims in order to overcome the effects of valve grinding and weakened springs.

An added feature of the present invention is that the valve locks are plated or color coded according to the position of the locking ridge on the valve locks. By coloring each of the valve locks a different color, the engine rebuilder can be sure that he does not use the wrong valve locks in rebuilding an engine. The distance modifications of thirty thousandths (0.030) or sixty thousandths (0.060) also can be printed on the valve locks to show their position, but color coding is a more effective way of achieving this purpose.

It should be understood that the foregoing is merely illustrative of the preferred practice of the present invention and that various changes and modifications may be made in the illustrated construction without departing from the spirit and scope of the present invention, which is defined in the appended claims.

I claim:

1. In a valve lock for locking a valve spring on a valve stem in an engine wherein the valve lock comprises a plurality of arcuate sections that have outer side walls that are tapered at a predetermined angle so as to mate with tapered side walls in an opening in a spring retainer, the valve lock further having cylindrical inner side walls having inwardly extending ridges at a predetermined axial position on the inner side walls that mate with a groove adjacent a tip of a valve stem, the improvement wherein the position of the ridges with respect to the tapered side walls is modified from the position of the ridges in an original equipment valve lock used for the engine when new by a distance sufficient to adjust the spring characteristics of the valve spring in a desired manner, the predetermined angle of the outer side walls of the improved valve lock being substantially the same as the predetermined angle of the outer side walls of the original equipment valve lock.

2. A valve lock according to claim 1 wherein the ridge positions are axially modified by a distance sufficient to compensate for a change in valve stem position due to valve and valve seat grinding in an engine.

3. A valve lock according to claim 1 wherein the ridge positions are axially modified by a distance sufficient to compensate for changes in spring characteristics in used springs, such that the valve lock provides for adjustment sufficient to compensate for changes in spring characteristics due to the use of a valve spring over a period of time in an engine.

4. A valve lock according to claim 2 wherein the ridge positions are modified by a distance sufficient to compensate for the re-use of used valve springs in an engine that has been provided with a valve job.

5. A valve lock according to claim 2 wherein the ridge positions are modified by a distance of about thirty thousandths (0.030) of an inch in an axial direction outwardly from the ridge positions in a valve lock used in a conventional new engine of the same type.

6. A valve lock according to claim 4 wherein the ridge positions are modified by a distance of about sixty thousandths (0.060) of an inch in an axial direction outwardly from the ridge positions in a valve lock used in a conventional new engine of the same type.

7. A valve lock according to claim 1 wherein the valve lock is visibly coded by a marking that readily distinguishes the valve lock and its particular ridge position from valve locks with other ridge positions.

8. A valve lock according to claim 7 wherein the valve lock is color coded to provide the visible coding.

9. An improved replacement valve lock for increasing valve spring pressure in an engine without the use of valve spring shims, the replacement valve locking having a tapered outer surface that is formed at a predetermined angle that mates with a tapered angle in an opening in a spring retainer, the replacement valve lock having a cylindrical inner side wall with that fits on a valve stem and includes a ridge extending inwardly from the inner side wall into a groove in a tip of the valve stem, the replacement valve lock having substantially the same angle of outer side wall taper as an original equipment valve lock used for the engine when new but the relative positions of the tapered outer side wall and the ridge are different from the original equipment valve lock, such that a point of contact of the tapered outer side wall with the spring retainer is positioned axially inwardly from the ridge a greater distance in the replacement valve lock than in the original equipment valve lock.

10. A process for increasing valve spring pressure in an engine in order to compensate for loss in spring pressure that would otherwise occur as a result of grinding valves or valve seats in the engine or as a result of valve springs losing compression strength through use, the engine being of the type wherein valve springs are retained on valve stems by spring retainers having tapered openings therein and wherein the spring retainers are retained on the valve stems by valve locks comprising a plurality of arcuate sections that have tapered outer surfaces that match the taper of the spring retainers and have inwardly extending ridges that engage grooves in the valve stems to locate the valve locks at a predetermined axial position on the valve stems, the position of the valve locks determining the position of the spring retainers on the valve stems and this in turn setting the extent of pre-compression of the valve springs,the process comprising replacement of the valve locks used as original equipment in the engine with modified valve locks having the same taper as the original equipment valve locks but wherein the modified valve locks have ridges that are shifted axially inwardly on the valve stems relative to the ridge positions of the original equipment valve locks in relation to the diameter of the valve locks, such that the modified valve locks modify the positions of the spring retainers on the valve stems, increasing valve spring pressure.

11. An improved replacement valve lock for increasing valve spring pressure in an engine without the use of valve spring shims, wherein the engine has original valve locks and original spring retainers, with the original valve locks and original spring retainers having mating tapered side walls that have the same taper angle, the original valve locks having ridges on inner sidewalls at a predetermined axial position relative to the diameter of the outer sidewalls, the ridges engaging grooves in a valve stem to position the valve locks and spring retainers at fixed positions on the valve stems, the replacement valve locks having the same taper angle as the original valve locks and hence being usable with the original spring retainers, the replacement valve locks having inner ridges that are positioned at axially displaced locations on the valve locks in relation to the diameter of the valve locks so as to modify the position of the spring retainers on the valve stems, thus modifying spring pressure.

* * * * *

UNITED STATES PATENT AND TRADEMARK OFFICE

CERTIFICATE OF CORRECTION

PATENT NO. : 5,873,563
DATED : February 23, 1999
INVENTOR(S) : George Hoving III It is certified that error appears in the above-identified patent and that said Letters Patent is hereby corrected as shown below:

Column 6,
Line 17, delete “inwardly on the valve stems” and insert -- outwardly --.

Signed and Sealed this

Twenty-second Day of February, 2005

JON W. DUDAS
*Director of the United States Patent and Trademark Office*